US009535368B2

(12) United States Patent
Murata

(10) Patent No.: US 9,535,368 B2
(45) Date of Patent: Jan. 3, 2017

(54) TONER SUPPLY DEVICE COMPRISING TONER CASE MOUNTING MEMBER HAVING A MOVABLE PORTION AND IMAGE FORMING APPARATUS INCLUDING THE SAME

(71) Applicant: KYOCERA Document Solutions Inc., Osaka-shi, Osaka (JP)

(72) Inventor: Koji Murata, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 28 days.

(21) Appl. No.: 14/169,079

(22) Filed: Jan. 30, 2014

(65) Prior Publication Data

US 2014/0219687 A1 Aug. 7, 2014

(30) Foreign Application Priority Data

Feb. 1, 2013 (JP) ..... 2013-018043

(51) Int. Cl.
*G03G 15/08* (2006.01)

(52) U.S. Cl.
CPC ..... *G03G 15/0877* (2013.01)

(58) Field of Classification Search
CPC ..... G03G 21/1676; G03G 2215/0682; G03G 15/0877
USPC ..... 399/258
See application file for complete search history.

(56) References Cited

U.S. PATENT DOCUMENTS

| | | | | |
|---|---|---|---|---|
| 5,440,376 | A * | 8/1995 | Hagihara | 399/120 |
| 7,756,450 | B2 * | 7/2010 | Kurimoto et al. | 399/258 |
| 8,078,087 | B2 * | 12/2011 | Yoshimoto et al. | 399/258 |
| 8,478,171 | B2 * | 7/2013 | Sasaki | 399/262 |
| 8,532,541 | B2 * | 9/2013 | Yahagi | 399/258 |
| 8,824,934 | B2 * | 9/2014 | Hayashi et al. | 399/258 |
| 9,002,239 | B2 * | 4/2015 | Kawarazuka | 399/258 |
| 2007/0258735 | A1 * | 11/2007 | Ban et al. | 399/258 |
| 2008/0013983 | A1 * | 1/2008 | Mihara | 399/106 |
| 2011/0311242 | A1 * | 12/2011 | Tanda | G03G 15/0868 399/27 |

FOREIGN PATENT DOCUMENTS

| | | | |
|---|---|---|---|
| JP | 06130812 | A | 5/1994 |
| JP | 2009204772 | A | 9/2009 |
| JP | 2012203102 | A | 10/2012 |

* cited by examiner

*Primary Examiner* — Billy Lactaoen
*Assistant Examiner* — Arlene Heredia Ocasio
(74) *Attorney, Agent, or Firm* — Alleman Hall McCoy Russell & Tuttle LLP

(57) ABSTRACT

A toner supply device according to one aspect of the present disclosure includes: a toner case configured to contain toner; and a mounting member on which the toner case is detachably mounted. The mounting member includes: a toner receiving portion configured to receive the toner discharged from the toner case; and a toner holding portion configured to hold the toner received by the toner receiving portion. The toner holding portion includes a movable portion disposed below the toner receiving portion. The movable portion is provided so as to be able to lift and lower relative to the toner receiving portion.

12 Claims, 7 Drawing Sheets

TONER SUPPLY DEVICE COMPRISING TONER CASE MOUNTING MEMBER HAVING A MOVABLE PORTION AND IMAGE FORMING APPARATUS INCLUDING THE SAME

INCORPORATION BY REFERENCE

This application is based upon and claims the benefit of priority from the corresponding Japanese Patent Application No. 2013-018043 filed on Feb. 1, 2013, the entire contents of which are incorporated herein by reference.

BACKGROUND

The present disclosure relates to a toner supply device and an image forming apparatus including the toner supply device.

Conventionally, an electrophotographic type image forming apparatus includes a toner supply device capable of supplying toner to an image carrier (e.g., a photosensitive drum). The toner supply device includes, for example, a toner case (e.g., a toner container) which contains the toner, and a mounting member (e.g., an intermediate tank or a developing unit) on which the toner case is detachably mounted.

Among toner supply devices having such a configuration, there is a device having a configuration in which a remaining amount of the toner within the mounting member is detected by a level sensor and toner supply from the toner case to the mounting member is controlled on the basis of a result of the detection. However, when such a configuration is employed, the level sensor and a complicated supply mechanism are required, which causes cost increase.

Meanwhile, among toner supply devices, there is a device having a configuration in which the toner is always continuously supplied from the toner case to the mounting member during a printing operation. When such a configuration is employed, it is made possible to assuredly supply the toner from the toner case to the mounting member without using a level sensor and a complicated supply mechanism.

However, when such a configuration is employed, as long as the toner remains within the toner case, the toner is always present at a connection portion between the toner case and the mounting member. Thus, when it is attempted to mount or detach the toner case onto or from the mounting member in a state where the toner is present at the connection portion, the toner case drags the toner present at the connection portion between the toner case and the mounting member, and thus the surface of the toner case is made dirty.

SUMMARY

A toner supply device according to one aspect of the present disclosure includes: a toner case configured to contain toner; and a mounting member on which the toner case is detachably mounted. The mounting member includes: a toner receiving portion configured to receive the toner discharged from the toner case; and a toner holding portion configured to hold the toner received by the toner receiving portion. The toner holding portion includes a movable portion disposed below the toner receiving portion. The movable portion is provided so as to be able to lift and lower relative to the toner receiving portion.

An image forming apparatus according to another aspect of the present disclosure includes a toner supply device and an image forming portion. The toner supply device includes a toner case configured to contain toner and a mounting member on which the toner case is detachably mounted. The image forming portion is configured to form an image by using the toner from the toner case of the toner supply device. The mounting member includes: a toner receiving portion configured to receive the toner discharged from the toner case; and a toner holding portion configured to hold the toner received by the toner receiving portion. The toner holding portion includes a movable portion disposed below the toner receiving portion. The movable portion is provided so as to be able to lift and lower relative to the toner receiving portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

First Embodiment

Figure 1:
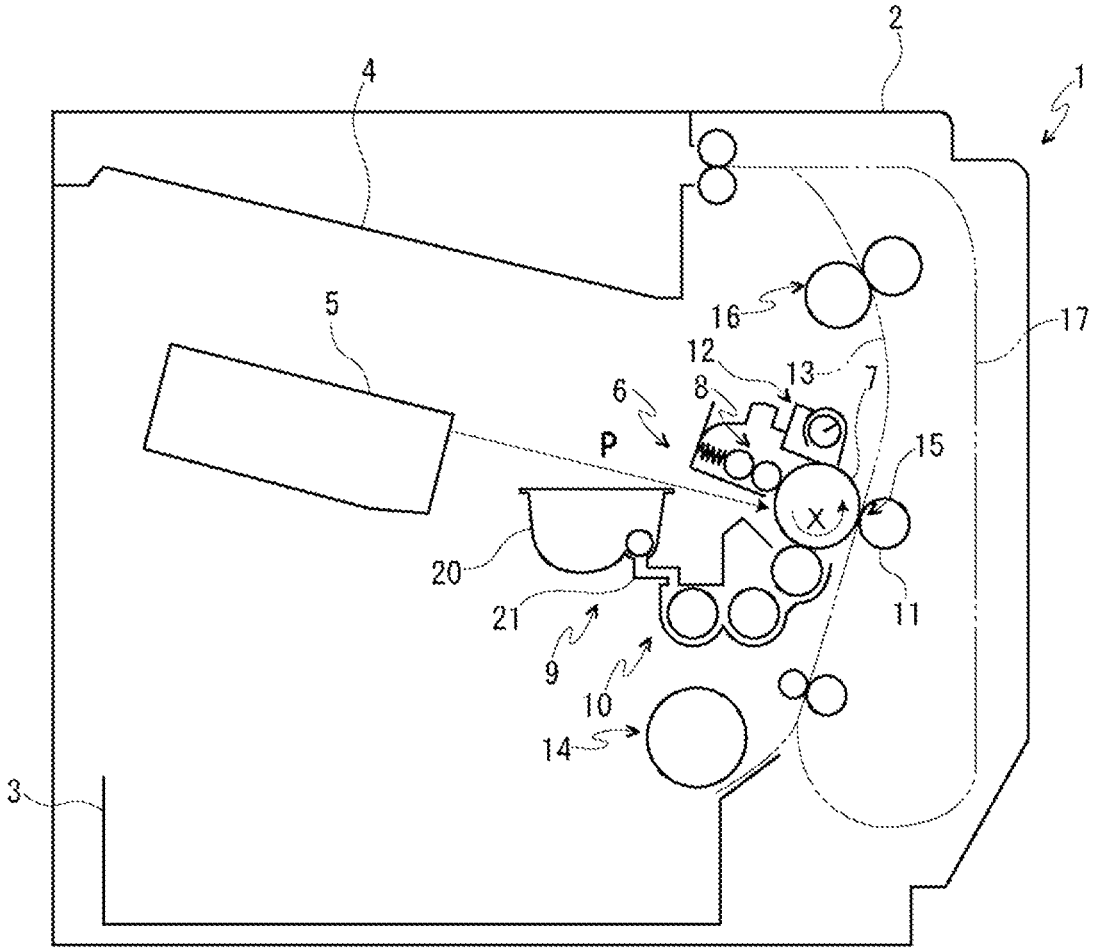
FIG. 1 is a schematic diagram showing the schematic configuration of a monochrome printer according to a first embodiment of the present disclosure.

First, the entire configuration of a monochrome printer 1 as an image forming apparatus will be described with reference to FIG. 1. Hereinafter, the near side of the surface of the sheet of FIG. 1 is defined as a front surface side (front side) of the monochrome printer 1.

The monochrome printer 1 includes a printer main body 2. A sheet feed cassette 3 which stores paper sheets (not shown) is provided in a lower portion of the printer main body 2, and a sheet discharge tray 4 is provided at an upper end of the printer main body 2.

An exposure unit 5 composed of a laser scanning unit (LSU) is disposed in an upper left portion of the printer main body 2, and an image forming portion 6 is provided in a right portion of the printer main body 2. A photosensitive drum 7 which is an image carrier is rotatably provided in the image forming portion 6, and a charging unit 8, a developing unit 10 connected to a toner supply device 9, a transfer roller 11, and a cleaning device 12 are disposed around the photosensitive drum 7 and along a rotation direction of the photosensitive drum 7 (see an arrow X in FIG. 1).

A sheet conveyance path 13 is provided in a right side portion of the printer main body 2 so as to extend from the lower side toward the upper side. A sheet feed portion 14 is provided at an upstream end of the conveyance path 13, a transfer portion 15 composed of the photosensitive drum 7 and the transfer roller 11 is provided at a middle portion of the conveyance path 13, and a fixing device 16 is provided at a downstream portion of the conveyance path 13. A reverse path 17 for double-sided printing is provided to the right of the conveyance path 13.

Next, an image forming operation of the monochrome printer 1 having such a configuration will be described.

When the monochrome printer 1 is powered on, various parameters are initialized, and initial setting such as temperature setting of the fixing device 16 is executed. Then, image data is inputted from a computer or the like connected to the monochrome printer 1. When an instruction for start of printing is given, an image forming operation is performed as follows.

First, the surface of the photosensitive drum 7 is charged by the charging unit 8, and then exposure corresponding the image data is performed on the photosensitive drum 7 by laser light (see an arrow P in FIG. 1) from the exposure unit 5, whereby an electrostatic latent image is formed on the surface of the photosensitive drum 7. Next, with toner supplied from the toner supply device 9, the developing unit 10 develops the electrostatic latent image into a toner image.

Meanwhile, a paper sheet taken by the sheet feed portion 14 from the sheet feed cassette 3 is conveyed to the transfer portion 15 at a timing synchronized with the above image forming operation, and the toner image on the photosensitive drum 7 is transferred onto the paper sheet at the transfer portion 15. The paper sheet on which the toner image has been transferred is conveyed on the conveyance path 13 toward the downstream side and enters the fixing device 16, and the toner image is fixed on the paper sheet at the fixing device 16. The paper sheet on which the toner image has been fixed is discharged through a downstream end of the conveyance path 13 to the sheet discharge tray 4. It is noted that the toner remaining on the photosensitive drum 7 is collected by the cleaning device 12.

Next, the toner supply device 9 will be described with reference to mainly FIGS. 2, 3A, and 3B.

Figure 2:
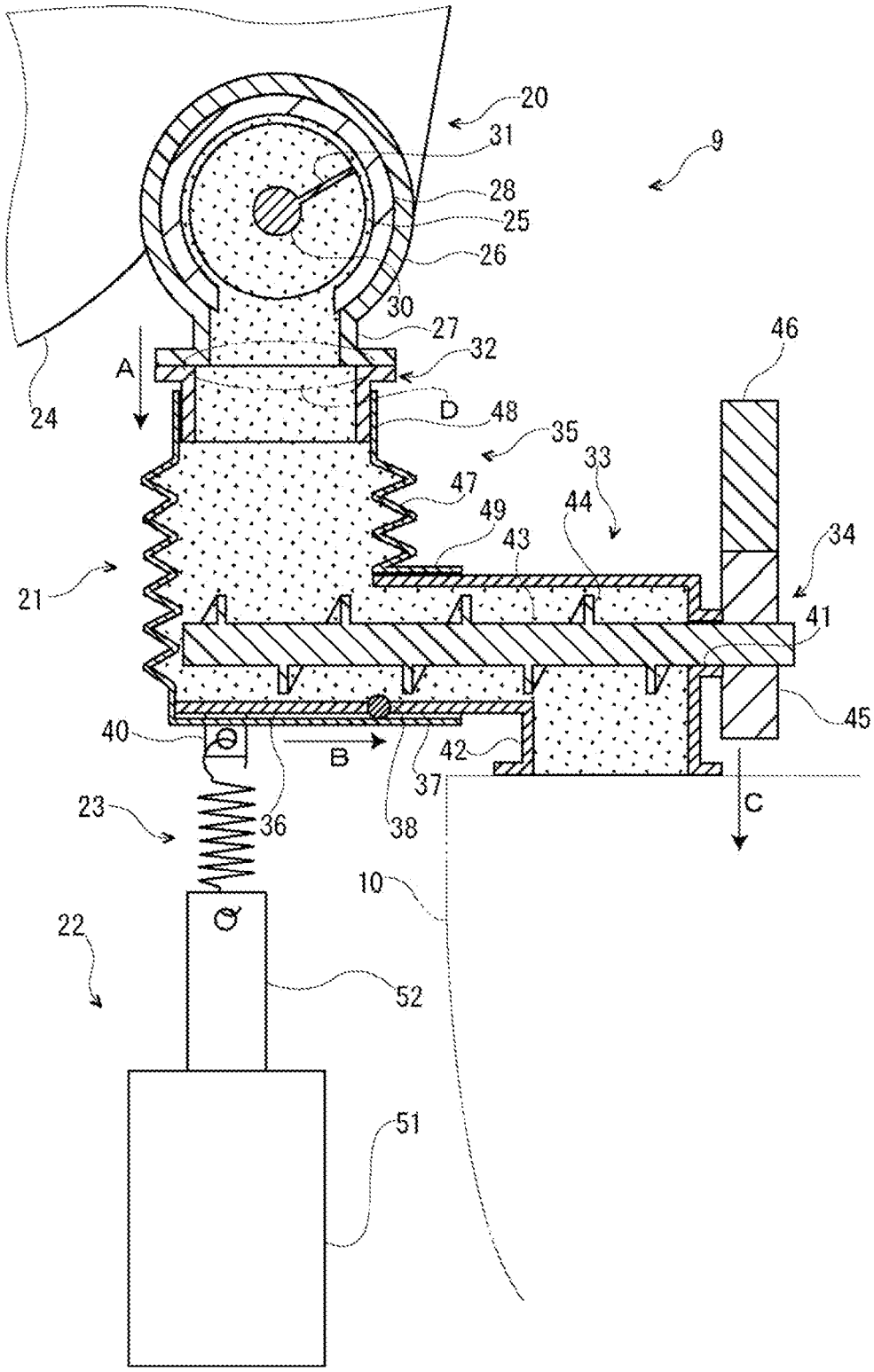
FIG. 2 is a cross-sectional view showing a state where a shutter of a toner container is opened and a movable portion of an intermediate tank is located at a lifted position in a toner supply device of the monochrome printer, according to the first embodiment of the present disclosure, shown in FIG. 1.

As shown in FIG. 2, the toner supply device 9 includes a toner container 20 as a toner case, an intermediate tank 21 as a mounting member which is disposed below the toner container 20, a solenoid 22 as a drive mechanism which is disposed below the intermediate tank 21, and a coil spring 23 as an elastic member which is disposed below the intermediate tank 21 and above the solenoid 22.

First, the toner container 20 will be described. The toner container 20 is detachably mounted on the intermediate tank 21. It is noted that regarding the toner container 20, only a lower right portion thereof is shown in FIG. 2 (see FIG. 1 for the entire shape of the toner container 20).

As shown in FIG. 2, the toner container 20 includes a case body 24 and a first conveying screw 25 (first conveying member) disposed at a lower right portion of the case body 24.

Figure 3A:
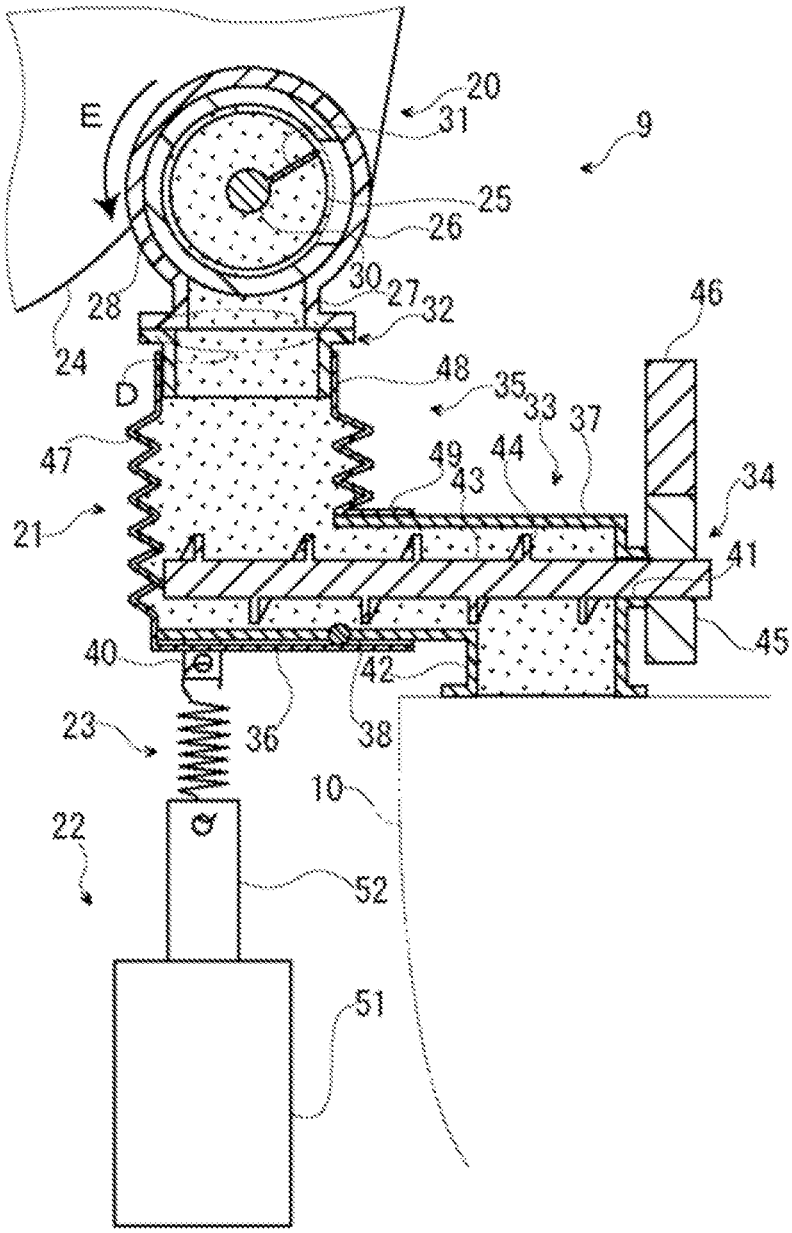
FIG. 3A is a cross-sectional view showing a state where the shutter of the toner container is closed and the movable portion of the intermediate tank is located at the lifted position in the toner supply device of the monochrome printer, according to the first embodiment of the present disclosure, shown in FIG. 1.
Figure 3B:
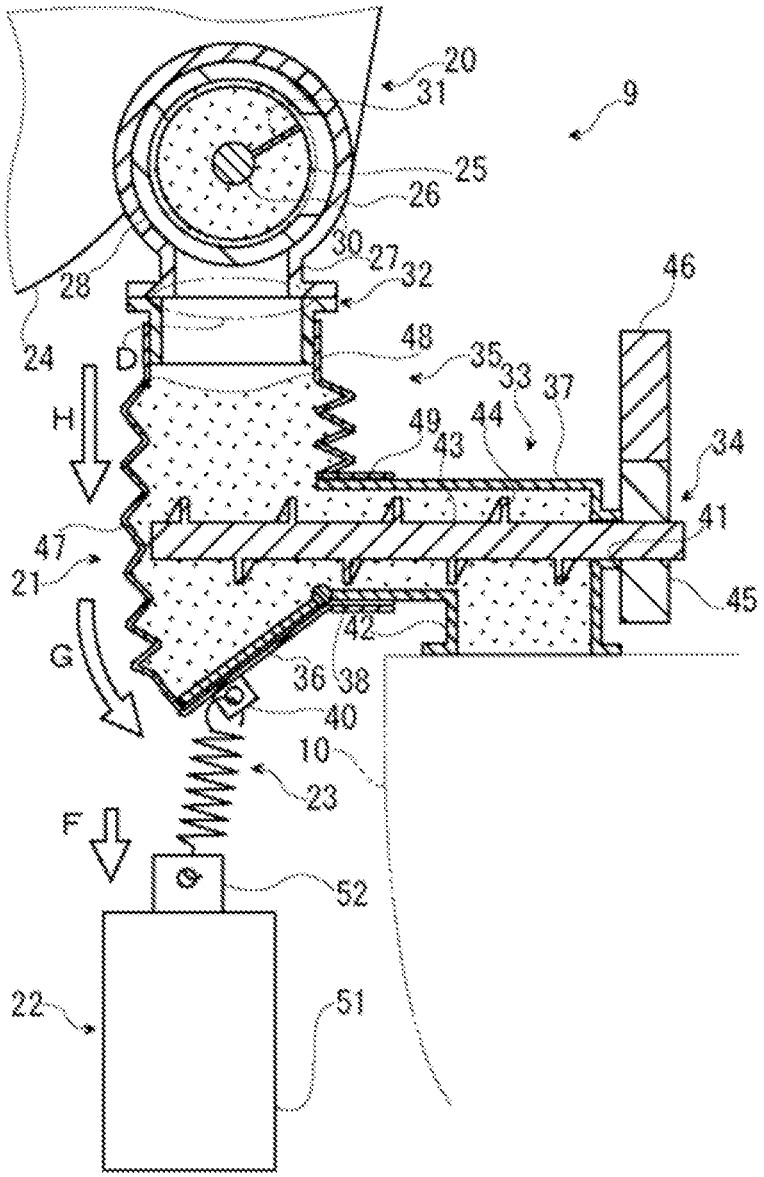
FIG. 3B is a cross-sectional view showing a state where the shutter of the toner container is closed and the movable portion of the intermediate tank is located at a lowered position.

The case body 24 contains toner (represented by a large number of black spots in FIGS. 2, 3A, and 3B). A discharge duct 26 is provided at the lower right portion of the case body 24, and a tubular toner discharge portion 27 is provided at a bottom portion of the discharge duct 26 so as to project downward. A shutter 28 is rotatably accommodated in the discharge duct 26. The shutter 28 is configured to rotate between an opened position (see FIG. 2) at which toner discharge from the toner discharge portion 27 is enabled and a closed position (see FIGS. 3A and 3B) at which the toner discharge from the toner discharge portion 27 is restrained. In other words, the shutter 28 is configured to open/close the toner discharge portion 27.

As shown in FIG. 2, the first conveying screw 25 is rotatably accommodated in the discharge duct 26 of the case body 24. The first conveying screw 25 includes a first rotation shaft 30 extending in a front-rear direction (the depth direction of the sheet surface of FIG. 2) and a helical first fin 31 provided on the periphery of the first rotation shaft 30. The first conveying screw 25 is provided directly above the toner discharge portion 27 of the case body 24.

Next, the intermediate tank 21 will be described. The intermediate tank 21 connects the toner container 20 to the developing unit 10 (see FIG. 1).

As shown in FIG. 2, the intermediate tank 21 includes a toner receiving portion 32, a toner holding portion 33 disposed so as to extend from directly below the toner receiving portion 32 to the diagonally lower right of the toner receiving portion 32, a second conveying screw 34 (second conveying member) supported by the toner holding portion 33, and a toner flowing portion 35 interposed between the toner receiving portion 32 and the toner holding portion 33.

The toner receiving portion 32 has a tubular shape. The toner receiving portion 32 is connected to the toner discharge portion 27 of the toner container 20 in a state where the toner container 20 is mounted on the intermediate tank 21.

The toner holding portion 33 includes a movable portion 36, a fixed portion 37 disposed lateral to the movable portion 36 (to the right thereof in the present embodiment), and a fulcrum portion 38 disposed at a boundary between the movable portion 36 and the fixed portion 37.

The movable portion 36 of the toner holding portion 33 is disposed below the toner receiving portion 32 (directly below the toner receiving portion 32 in the present embodiment). The movable portion 36 has a flat plate shape. A mounting piece 40 is provided on a left portion of a bottom of the movable portion 36 so as to project therefrom. A right end portion of the movable portion 36 is mounted on the fulcrum portion 38, and the movable portion 36 is configured to lift and lower relative to the toner receiving portion 32 by rotating up and down about the fulcrum portion 38 (see FIGS. 2, 3A, and 3B). Thus, it is made possible to lift and lower the movable portion 36 with a smaller force than that required when the entire toner holding portion 33 is rotated up and down. Hereinafter, a position at which the movable portion 36 is kept in a substantially horizontal orientation (see FIGS. 2 and 3A) is referred to as "lifted position" of the movable portion 36, and a position to which the movable portion 36 is rotated downward from the lifted position (see FIG. 3B) is referred to as "lowered position" of the movable portion 36.

As shown in FIG. 2, the fixed portion 37 has a tubular shape. The fixed portion 37 extends in a right-left direction. An insertion hole 41 is formed in a right end wall of the fixed portion 37 so as to extend therethrough in the right-left direction. A lower wall of the fixed portion 37 is disposed at substantially the same height as the movable portion 36. A tubular toner supply portion 42 is provided at a right portion of the lower wall of the fixed portion 37 so as to project downward therefrom. A lower end portion of the toner supply portion 42 is connected to the developing unit 10.

The second conveying screw 34 includes a second rotation shaft 43 extending in the right-left direction, a helical second fin 44 provided on the periphery of the second rotation shaft 43, and a driven gear 45 fixed to a right end portion of the second rotation shaft 43.

The second rotation shaft 43 of the second conveying screw 34 is inserted through the insertion hole 41 provided in the right end wall of the fixed portion 37 of the toner holding portion 33. Thus, the second conveying screw 34 is rotatably supported by the toner holding portion 33. The right end portion of the second rotation shaft 43 projects to the right (outside) of the toner holding portion 33.

The second fin 44 of the second conveying screw 34 is provided on the periphery of a portion of the second rotation shaft 43 extending from its left end portion to its right portion. The second fin 44 is accommodated in the toner holding portion 33.

The driven gear 45 of the second conveying screw 34 is disposed to the right (outside) of the toner holding portion 33. The driven gear 45 meshes with a drive gear 46 connected to a drive source (not shown). When the drive gear 46 is rotated by the drive source, the rotation is transmitted to the driven gear 45 to rotate the second conveying screw 34.

The toner flowing portion 35 is formed in a tubular shape from a stretchable material such as rubber or the like. The toner flowing portion 35 includes an intermediate portion 47, an upper mounted portion 48 provided at the upper side of the intermediate portion 47, and a lower mounted portion 49 provided at the lower side of the intermediate portion 47. The intermediate portion 47 is formed in a bellows shape so as to be able to stretch and contract in an up-down direction. The upper mounted portion 48 is mounted on the outer periphery of the toner receiving portion 32. The lower mounted portion 49 covers the lower side of the movable portion 36 of the toner holding portion 33 and is mounted on the outer periphery of the fixed portion 37 of the toner holding portion 33. Since the intermediate portion 47 of the toner flowing portion 35 is provided so as to be able to stretch and contract in the up-down direction as described above, it is possible to avoid a situation where the toner leaks from between the toner receiving portion 32 and the toner holding portion 33 when the movable portion 36 lifts or lowers. In addition, since the entirety of the toner flowing portion 35 is formed from a stretchable material such as rubber or the like, it is made possible to enhance the stretchability of the toner flowing portion 35.

Next, the solenoid 22 will be described. The solenoid 22 includes a casing 51 and a plunger 52 supported by the casing 51. The casing 51 is fixed to, for example, the printer main body 2 (see FIG. 1). The plunger 52 is configured to linearly reciprocate up and down. Since the solenoid 22 which lifts and lowers the movable portion 36 is provided as described above, the necessity of a user, a serviceman, or the like to manually lift and lower the movable portion 36 is eliminated, and it is made possible to reduce a load on the operator. In addition, since the solenoid 22 is used as a drive mechanism, it is made possible to lift or lower the movable portion 36 at any timing.

Next, the coil spring 23 will be described. An upper end portion of the coil spring 23 is mounted on the mounting piece 40 of the movable portion 36 of the toner holding portion 33. A lower end portion of the coil spring 23 is mounted on the plunger 52 of the solenoid 22. In this manner, the coil spring 23 is interposed between the plunger 52 of the solenoid 22 and the movable portion 36. Thus, the coil spring 23 allows alleviation of an impact applied to the movable portion 36 when the movable portion 36 is lifted or lowered by the solenoid 22. In addition, the plunger 52 which linearly reciprocates up and down allows the movable portion 36 to be smoothly rotated up and down.

In the above configuration, in supplying the toner to the developing unit 10, the first conveying screw 25 of the toner container 20 is rotated and the second conveying screw 34 of the intermediate tank 21 is also rotated. When the first conveying screw 25 rotates as described above, the toner contained in the toner container 20 is discharged through the toner discharge portion 27 and received by the toner receiving portion 32 of the intermediate tank 21 (see an arrow A in FIG. 2). The toner received thus by the toner receiving portion 32 passes through the toner flowing portion 35, moves down to the toner holding portion 33, and is held by the movable portion 36 of the toner holding portion 33. The toner held thus by the movable portion 36 of the toner holding portion 33 is conveyed rightward within the fixed portion 37 of the toner holding portion 33 by the second conveying screw 34 (see an arrow B in FIG. 2) and supplied from the intermediate tank 21 through the toner supply portion 42 to the developing unit 10 (see an arrow C in FIG. 2).

It is noted that the first conveying screw 25 always rotates during a printing operation, and thereby the toner is continuously supplied from the toner container 20 to the intermediate tank 21. Thus, the insides of the toner discharge portion 27 of the toner container 20 and the intermediate tank 21 are filled with the toner.

Next, an operation performed when the toner container 20 is detached from the intermediate tank 21 will be described. In a state where the toner container 20 is mounted on the intermediate tank 21 (e.g., in a state where a printing operation is performed), the shutter 28 of the toner container 20 is located at the opened position as shown in FIG. 2. In addition, the plunger 52 of the solenoid 22 is lifted, and the movable portion 36 of the intermediate tank 21 is located at the lifted position. Moreover, the toner discharge portion 27 of the toner container 20 and the intermediate tank 21 are filled with the toner, except in the case where the toner within the toner container 20 is used up. Thus, the toner is present at a connection portion D between the toner container 20 and the intermediate tank 21 (hereinafter, referred to merely as "connection portion D"). In addition, the intermediate portion 47 of the toner flowing portion 35 of the intermediate tank 21 is contracted.

From this state, first, the shutter 28 of the toner container 20 is rotated from the opened position to the closed position as indicated by an arrow E in FIG. 3A. Based on such a movement, communication between the toner container 20 and the intermediate tank 21 is cut off, and thus toner discharge from the toner discharge portion 27 is restrained.

Next, the solenoid 22 is actuated such that the plunger 52 of the solenoid 22 is lowered as indicated by an arrow F in FIG. 3B. Based on such a movement, the plunger 52 of the solenoid 22 pulls downward the movable portion 36 of the toner holding portion 33 via the coil spring 23, so that the movable portion 36 rotates about the fulcrum portion 38 from the lifted position to the lowered position as indicated by an arrow G in FIG. 3B. Based on such a movement, the intermediate portion 47 of the toner flowing portion 35 of the intermediate tank 21 stretches downward as indicated by an arrow H in FIG. 3B, and the toner present at the connection portion D sinks into the intermediate tank 21, so that a space occurs at the connection portion D. In this state, the toner container 20 is pulled out from the intermediate tank 21 toward the near side, whereby the toner container 20 is detached from the intermediate tank 21. It is noted that the amount of rotation of the movable portion 36 suffices to be a small amount of rotation that is enough to allow a space to occur at the connection portion D.

On the other hand, in mounting the toner container 20 onto the intermediate tank 21, first, the toner discharge portion 27 of the toner container 20 is connected to the toner receiving portion 32 of the intermediate tank 21 as shown in FIG. 3B. Then, the solenoid 22 is actuated such that the plunger 52 of the solenoid 22 is lifted as shown in FIG. 3A. Based on such a movement, the plunger 52 of the solenoid 22 presses upward the movable portion 36 of the toner holding portion 33 via the coil spring 23, so that the movable portion 36 rotates about the fulcrum portion 38 from the lowered position to the lifted position. Based on such a movement, the intermediate portion 47 of the toner flowing portion 35 of the intermediate tank 21 contracts upward, and the toner having sunk within the intermediate tank 21 returns to the connection portion D. It is noted that the toner merely returns by an amount by which the toner has sunk once, and thus the toner is not compressed and there is no influence on the performance of the toner. Finally, the shutter 28 of the toner container 20 is rotated from the closed position to the opened position as shown in FIG. 2. By so doing, the mounting of the toner container 20 onto the intermediate tank 21 is completed.

In the present embodiment, as described above, the movable portion 36 is provided so as to be able to lift and lower relative to the toner receiving portion 32, and by lowering the movable portion 36 relative to the toner receiving portion 32 before mounting or detaching the toner container 20 onto or from the intermediate tank 21, the toner present at the connection portion D is caused to sink into the intermediate tank 21, whereby it is made possible to cause a space to occur at the connection portion D. Thus, it is made possible to avoid the toner container 20 from dragging the toner in mounting or detaching the toner container 20 onto or from the intermediate tank 21, and thus it is made possible to prevent the surface of the toner container 20 from being made dirty by the toner. In addition, since it is possible to prevent the surface of the toner container 20 from being made dirty by the toner without using a level sensor and a complicated supply mechanism, it is possible to achieve a reduction in the cost of the toner supply device 9.

In addition, since the toner container 20 is a toner case and the intermediate tank 21 is a mounting member, it is made possible to prevent the surface of the toner container 20 from being made dirty by the toner in mounting or detaching the toner container 20 onto or from the intermediate tank 21.

In addition, in the present embodiment, in detaching the toner container 20 from the intermediate tank 21, after the shutter 28 of the toner container 20 is rotated from the opened position to the closed position, the movable portion 36 is rotated from the lifted position to the lowered position. Thus, it is possible to cause the toner present at the connection portion D to sink into the intermediate tank 21 in a state where toner discharge from the toner container 20 to the intermediate tank 21 is restrained, and it is made possible to assuredly cause a space to occur at the connection portion D.

Meanwhile, in another different embodiment, in detaching the toner container 20 from the intermediate tank 21, after the movable portion 36 is rotated from the lifted position to the lowered position, the shutter 28 of the toner container 20 may be rotated from the opened position to the closed position. In this case, the shutter 28 is rotated after the toner is removed from the vicinity of the shutter 28 of the toner container 20, and thus it is made possible to prevent the shutter 28 from contacting with the toner. Therefore, it is made possible to prevent the shutter 28 from dragging the toner, and it is made possible to further effectively prevent the toner container 20 from being made dirty by the toner.

In the present embodiment, in mounting the toner container 20 onto the intermediate tank 21, after the movable portion 36 is rotated from the lowered position to the lifted position, the shutter 28 of the toner container 20 is rotated from the closed position to the opened position. On the other hand, in another different embodiment, in mounting the toner container 20 onto the intermediate tank 21, after the shutter 28 of the toner container 20 is rotated from the closed position to the opened position, the movable portion 36 may be rotated from the lowered position to the lifted position.

In the present embodiment, the case has been described where the movable portion 36 is lifted and lowered in mounting or detaching the toner container 20 onto or from the intermediate tank 21, but the timing when the movable portion 36 is lifted and lowered is not limited to this. For example, in another different embodiment, the movable portion 36 may be lifted at the time of start of printing, and the movable portion 36 may be lowered at the time of end of the printing.

In the present embodiment, the case has been described where the movable portion 36 is disposed directly below the toner receiving portion 32, but in another different embodiment, the movable portion 36 may be disposed diagonally below the toner receiving portion 32. In other words, "below the toner receiving portion 32" includes not only directly below the toner receiving portion 32 but also diagonally below the toner receiving portion 32.

Figure 4A:
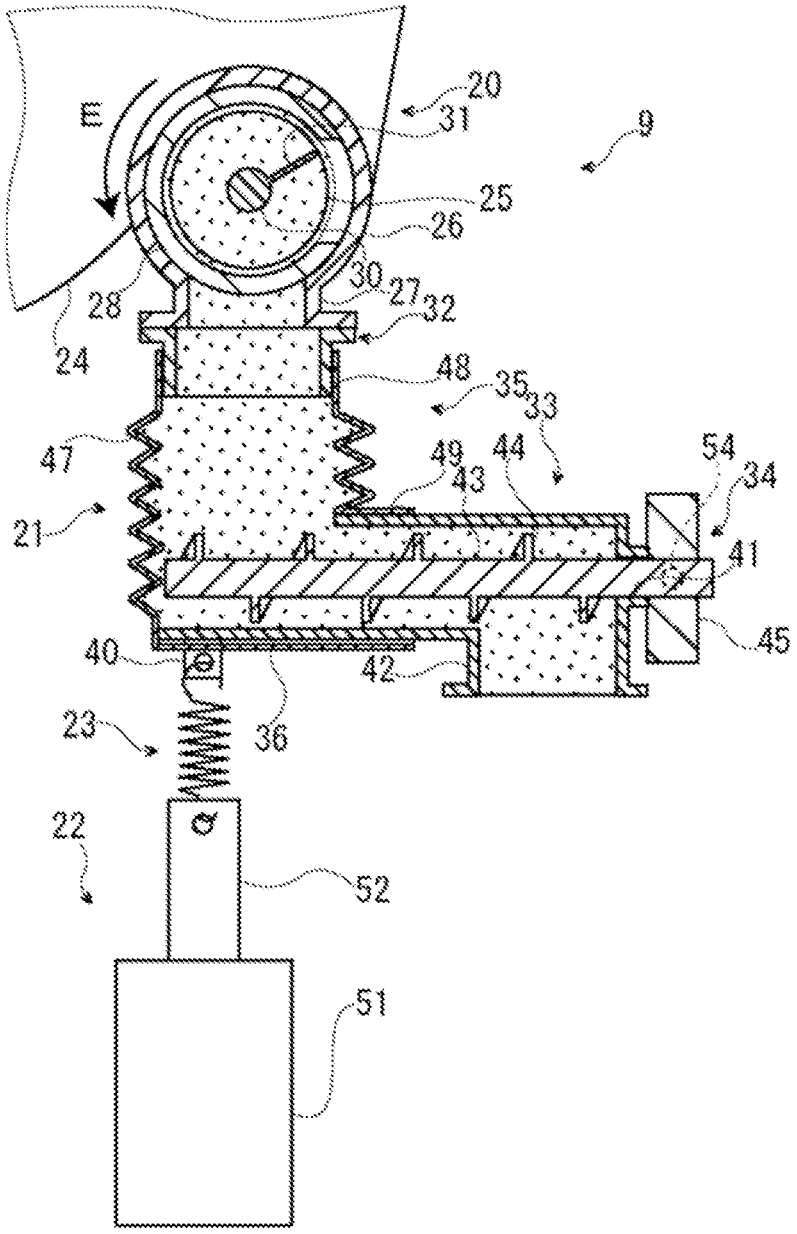
FIG. 4A is a cross-sectional view showing a state where a movable portion of an intermediate tank is located at a lifted position in a toner supply device according to another different embodiment.
Figure 4B:
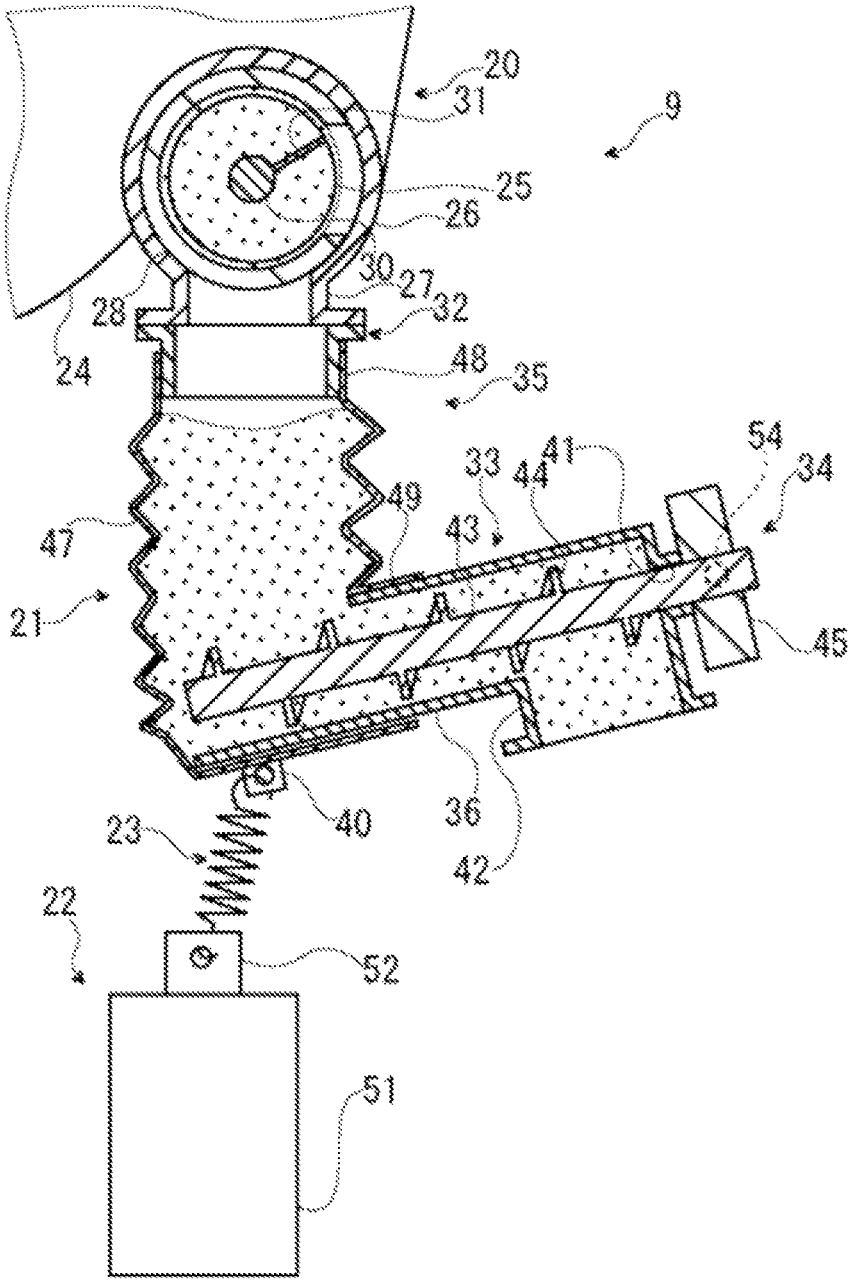
FIG. 4B is a cross-sectional view showing a state where the movable portion of the intermediate tank is located at a lowered position.

In the present embodiment, the case has been described where only the movable portion 36 of the toner holding portion 33 rotates about the fulcrum portion 38. Meanwhile, in another different embodiment, as shown in FIGS. 4A and 4B, a support shaft 54 may be provided in the intermediate tank 21 and disposed lateral to the movable portion 36 (e.g., to the right thereof), and the movable portion 36 may be lifted and lowered by rotating the entirety of the toner holding portion 33 about the support shaft 54 up and down. By employing such a configuration, it is made possible to avoid a situation where the toner leaks from the gap between the movable portion and the fixed portion of the toner holding portion 33.

In the present embodiment, the configuration has been described in which the movable portion 36 lifts and lowers relative to the toner receiving portion 32 by rotating up and down. However, in another different embodiment, the movable portion 36 may lift and lower relative to the toner receiving portion 32 by linearly sliding up and down.

In the present embodiment, the case has been described where the toner container 20 is a toner case and the intermediate tank 21 is a mounting member. Meanwhile, in another different embodiment, the toner container 20 may be a toner case and the developing unit 10 may be a mounting member.

In the present embodiment, the case has been described where the configuration of the present disclosure is applied to the monochrome printer 1. However, in another different embodiment, the configuration of the present disclosure is applicable to other image forming apparatuses such as a color printer, a copying machine, a facsimile, a multifunction peripheral, and the like.

Second Embodiment

Figure 5:
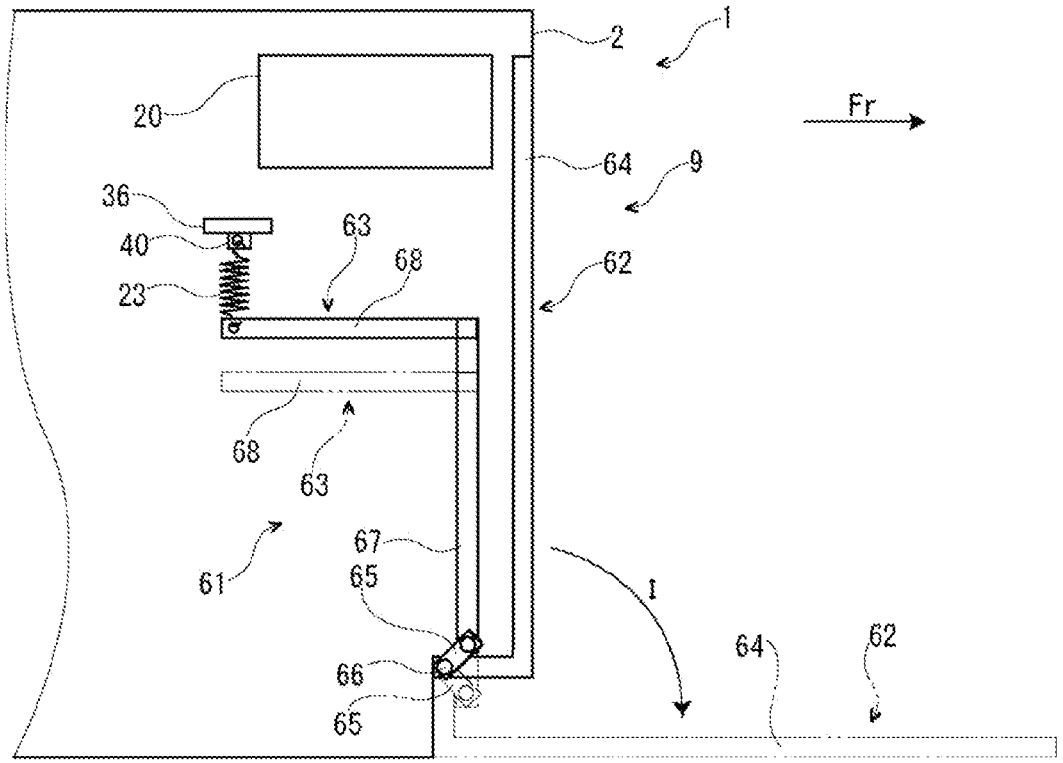
FIG. 5 is a left side view showing a drive mechanism in a toner supply device of a monochrome printer according to a second embodiment of the present disclosure.

Next, a toner supply device 9 according to a second embodiment of the present disclosure will be described with reference to FIG. 5. In FIG. 5, an arrow Fr indicates a front side (front surface side) of a printer 1. It is noted that the configuration other than a drive mechanism 61 is the same as that in the first embodiment, and thus the description thereof is omitted. In addition, in FIG. 5, regarding the toner container 20, only an outer shape thereof is illustrated, and regarding the intermediate tank 21, only the movable portion 36 is illustrated.

The drive mechanism 61 includes a cover member 62 provided at the front side of the printer main body 2 and a link arm 63 as a link mechanism which is provided at the rear side of the cover member 62.

The cover member 62 includes a cover main body 64 and a swinging piece 65 provided at a lower end side of the cover main body 64.

A shaft portion 66 is provided at a lower end portion of the cover main body 64, and the cover member 62 is configured to be opened and closed by rotating about the shaft portion 66. The cover main body 64 covers the front side of the toner container 20 in a state where the cover member 62 is closed.

An end portion of the swinging piece 65 is fixed to the shaft portion 66 of the cover main body 64, and the swinging piece 65 is configured to swing up and down by the cover member 62 rotating about the shaft portion 66.

The link arm 63 includes a first arm portion 67 extending in the vertical direction and a second arm portion 68 bent rearward from an upper end of the first arm portion 67. A lower end portion of the first arm portion 67 is rotatably mounted on another end portion of the swinging piece 65 of the cover member 62. The lower end portion of the coil spring 23 is mounted on a rear end portion of the second arm portion 68. Similarly to the first embodiment, the upper end portion of the coil spring 23 is mounted on the mounting piece 40 of the movable portion 36.

In the above configuration, in detaching the toner container 20 from the intermediate tank 21, the cover member 62 is rotated frontward, whereby the cover member 62 is opened to expose a part of the toner container 20 (see an alternate long and two short dashes line in FIG. 5). When the cover member 62 is rotated frontward as described above, the swinging piece 65 of the cover member 62 swings downward, and the link arm 63 lowers. Based on such a movement, the link arm 63 pulls downward the movable portion 36 via the coil spring 23, so that the movable portion 36 rotates about the fulcrum portion 38 from the lifted position to the lowered position. A movement of each portion after this is the same as in the first embodiment.

On the other hand, in mounting the toner container 20 onto the intermediate tank 21, after the toner container 20 is connected to the intermediate tank 21, the cover member 62 is rotated rearward, whereby the cover member 62 is closed (see a solid line in FIG. 5). When the cover member 62 is rotated rearward as described above, the swinging piece 65 of the cover member 62 swings upward, and the link arm 63 lifts. Based on such a movement, the link arm 63 presses upward the movable portion 36 via the coil spring 23, so that the movable portion 36 rotates about the fulcrum portion 38 from the lowered position to the lifted position. A movement of each portion after this is the same as in the first embodiment.

In the present embodiment, since the cover member 62 and the link arm 63 constitute the drive mechanism 61 as described above, it is possible to assuredly lift and lower the movable portion 36 in conjunction with opening and closing of the cover member 62. In addition, it is made possible to reduce the cost of the drive mechanism as compared to an electric drive mechanism such as a solenoid, a motor, or the like.

In the first embodiment, the case has been described where the solenoid 22 is used as a drive mechanism, and in the second embodiment, the case has been described where the cover member 62 and the link arm 63 are used as the drive mechanism 61. Meanwhile, in another different embodiment, another different drive mechanism such as a motor or the like may be used. In addition, in still another different embodiment, the movable portion 36 may be manually lifted and lowered without using a drive mechanism.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A toner supply device comprising:

a toner case configured to contain toner; and a mounting member on which the toner case is detachably mounted, wherein the mounting member is an intermediate tank connecting the toner container to a developing unit, the mounting member includes:

a toner receiving portion configured to receive the toner discharged from the toner case;

a toner flowing portion provided below the toner receiving portion and configured to allow the toner received by the toner receiving portion to flow downward; and a toner holding portion provided below the toner flowing portion, having a shape of a tube extending laterally from a lower portion of the toner flowing portion, and configured to hold the toner that has flowed through the toner flowing portion, and the toner holding portion includes: a toner supply portion disposed at an end, in an extension direction, of a lower wall of the toner holding portion and configured to guide the toner held inside the toner holding portion to the developing unit; and a conveying member provided inside the toner holding portion and configured to convey the toner held inside the toner holding portion toward the toner supply portion, wherein the toner holding portion is configured to be able to lift and lower by being supported so as to be able to move in an up-down direction together with the toner supply portion and the conveying member in a state where the lower portion of the toner flowing portion is connected to an outer circumferential surface of the toner holding portion, and a circumferential surface of a lower part of the toner flowing portion is configured to be able to stretch and contract in the up-down direction in correspondence with lifting and lowering of the toner holding portion when the toner holding portion lifts and lowers with respect to the toner receiving portion.

2. The toner supply device according to claim 1, wherein the mounting member further includes a support shaft disposed ahead of the toner supply portion in the extension direction, the toner holding portion is supported so as to be able to, as a whole, rotate about the support shaft in the up-down direction, and when the toner holding portion rotates downward, the circumferential surface of the lower part of the toner flowing portion stretches downward, thereby causing the toner inside the toner flowing portion to sink downward.

3. The toner supply device according to claim 1, further comprising a drive mechanism configured to lift and lower the toner holding portion.

4. The toner supply device according to claim 3, further comprising an elastic member interposed between the drive mechanism and the toner holding portion.

5. The toner supply device according to claim 3, wherein the drive mechanism includes:

a cover member provided so as to be able to be opened and closed; and a link mechanism configured to lower the toner holding portion based on the cover member being opened and to lift the toner holding portion based on the cover member being closed.

6. The toner supply device according to claim 1, wherein the toner case is a toner container including:

a toner discharge portion configured to discharge the toner; and a shutter configured to be movable between an opened position at which toner discharge from the toner discharge portion is enabled and a closed position at which the toner discharge from the toner discharge portion is restrained.

7. An image forming apparatus comprising:

a toner supply device including a toner case configured to contain toner and a mounting member on which the toner case is detachably mounted; and an image forming portion configured to form an image by using the toner from the toner case of the toner supply device, wherein the mounting member is an intermediate tank connecting the toner container to a developing unit, the mounting member includes:

a toner receiving portion configured to receive the toner discharged from the toner case;

a toner flowing portion provided below the toner receiving portion and configured to allow the toner received by the toner receiving portion to flow downward; and a toner holding portion provided below the toner flowing portion, having a shape of a tube extending laterally from a lower portion of the toner flowing portion, and configured to hold the toner that has flowed through the toner flowing portion, and the toner holding portion includes: a toner supply portion disposed at an end, in an extension direction, of a lower wall of the toner holding portion and configured to guide the toner held inside the toner holding portion to the developing unit; and a conveying member provided inside the toner holding portion and configured to convey the toner held inside the toner holding portion toward the toner supply portion, wherein the toner holding portion is configured to be able to lift and lower by being supported so as to be able to move in an up-down direction together with the toner supply portion and the conveying member in a state where the lower portion of the toner flowing portion is connected to an outer circumferential surface of the toner holding portion, and a circumferential surface of a lower part of the toner flowing portion is configured to be able to stretch and contract in the up-down direction in correspondence with lifting and lowering of the toner holding portion when the toner holding portion lifts and lowers with respect to the toner receiving portion.

8. The image forming apparatus according to claim 7, wherein the mounting member further includes a support shaft disposed ahead of the toner supply portion in the extension direction, the toner holding portion is supported so as to be able to, as a whole, rotate about the support shaft in the up-down direction, and when the toner holding portion rotates downward, the circumferential surface of the lower part of the toner flowing portion stretches downward, thereby causing the toner inside the toner flowing portion to sink downward.

9. The image forming apparatus according to claim 7, further comprising a drive mechanism configured to lift and lower the toner holding portion.

10. The image forming apparatus according to claim 9, further comprising an elastic member interposed between the drive mechanism and the toner holding portion.

11. The image forming apparatus according to claim 9, wherein the drive mechanism includes:

a cover member provided so as to be able to be opened and closed; and a link mechanism configured to lower the toner holding portion based on the cover member being opened and to lift the toner holding portion based on the cover member being closed.

12. The image forming apparatus according to claim 7, wherein the toner case is a toner container including:

a toner discharge portion configured to discharge the toner; and a shutter configured to be movable between an opened position at which toner discharge from the toner discharge portion is enabled and a closed position at which the toner discharge from the toner discharge portion is restrained.

* * * * *